US006224715B1

(12) United States Patent
Siquet

(10) Patent No.: US 6,224,715 B1
(45) Date of Patent: May 1, 2001

(54) DEVICE AND METHOD FOR HANDLING A MATERIAL WEB

(75) Inventor: Marcel Siquet, Chaudfontaine (BE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/401,950

(22) Filed: Sep. 23, 1999

(30) Foreign Application Priority Data

Nov. 5, 1998 (DE) ..... 198 50 760

(51) Int. Cl.[7] ..... D21F 2/00

(52) U.S. Cl. ..... 162/306; 162/306; 162/202; 34/114; 34/116; 34/155

(58) Field of Search ..... 162/306, 202; 34/114, 116, 155

(56) References Cited

U.S. PATENT DOCUMENTS 4,821,429 * 4/1989 Sieberth ..... 34/114

FOREIGN PATENT DOCUMENTS 3836751 6/1989 (DE) .
4314475 12/1993 (DE) .
29601543 5/1996 (DE) .
195 27 289 1/1997 (DE) .
197 14 758 10/1998 (DE) .

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Device and method for handling a material web, in which the material web is guided by at least one smooth support surface and is then guided together with a porous support belt to a deflection roll includes a suction box. The suction box has a wall opposite from the porous support belt, and creates a vacuum that draws the material web from the support surface to the porous support belt. The device also includes at least one sealing element positioned near a front end, in the web travel direction, the sealing element cooperating with the porous support belt, and a vacuum zone in which the vacuum is provided. The vacuum zone adjoins a side of the porous support belt not contacting the material web and is defined between the porous support belt, the at least one sealing element, the wall of the suction box, and at its rear end, the deflection roll. The device also includes a slot-shaped first suction opening provided in the suction box wall near the rear end of the vacuum zone adjacent to the deflection roll so that air can be aspirated from the vacuum through the first suction opening; and at least one additional suction opening communicating with the vacuum. The at least one additional suction opening is provided in the suction box wall.

19 Claims, 3 Drawing Sheets

DEVICE AND METHOD FOR HANDLING A MATERIAL WEB

CROSS-REFERENCE TO RELATED APPLICATION

The present application claims priority under 35 U.S.C. § 119 of German patent application No. 198 50 760.7, filed on Nov. 5, 1998, the disclosure of which is expressly incorporated by reference herein in its entirety.

BACKGROUND OF THE INVENTION

1. Field of the Invention

The present invention relates to a device for treating handling a material web, such as a paper or cardboard web. More particularly, the material web is guided by at least one smooth support surface and is then guided together with a porous support belt to a deflection roll or the like. The material web leaving the support surface is drawn against the porous support belt by a vacuum. The vacuum is provided within a vacuum zone defined by a side of the porous support belt facing away from the material web and an opposing wall of a suction box. The vacuum zone is sealed on its front end in the web travel direction by at least one scaling element that cooperates with the support belt and extends with its rear end to the deflection roll. The suction box wall is provided with a slot-shaped first suction opening in the vicinity of the rear end of the vacuum zone. Air can be aspirated from the vacuum zone through the opening.

2. Discussion of Background Information

In a device known from DE-A1-195 27 289, the suction box wall opposite from the porous support belt is only provided with a suction opening near the rear end, in terms of the web travel direction.

As soon as the material web leaves the support surface, which is embodied, for example, as a drying cylinder, it is held by the vacuum against the back side of the porous support belt, which is embodied, for example, as a drying wire. The prior suction box principle, however, has several disadvantages. Even if the scaling element rests directly against the porous support belt, which is practically never the case, air cannot be prevented from filling the vacuum zone, even in the immediate vicinity of this sealing element. This can be attributed to the porous nature of the support belt, which permits air flow. Thus, a pressure loss occurs after the sealing element. Moreover, the still-moist material web has a tendency to adhere to the smooth support surface. Consequently, a vacuum sufficient to draw the material web to the porous support belt is only available within a certain distance from the sealing element.

Problems also arise when beginning each material web which, as a rule, is carried out in two steps. Thus, upon insertion of the tip or the leading edge of a material web without ropes, because of the adhesion to the smooth support surface as well as the lack of negative pressure behind the uncovered or at best only slightly covered support belt, the tip does not detach from the smooth support surface, As a result, the tip remains adhered to the support surface until it comes to a scraper, which is customarily provided, such that it finally returns to the support belt by means of air pressure. Even when the tip is carried along by the porous support belt, air can still travel through the support belt into the vacuum zone, especially around the sides of the tip, resulting in a significant weakening of the vacuum. Consequently, a vacuum sufficient to draw the material web against the support belt and secure it there is only available near the suction slot provided close to the rear end of the vacuum zone.

Up until now, adhesion of the web to the smooth support surface has always been counteracted b dividing the Suction box and/or the vacuum zone to generate a more intense vacuum, for example, across the width of the tip. Such a box structure is, however, expensive and complex, particularly because appropriate dividers are required. Only when the material web has widened out to its full extent and the porous support belt is covered at least substantially across its entire width, is there sufficient negative pressure in the entire vacuum zone to draw the material web against the support belt and secure it there. However, external air can also easily penetrate through the porous support belt and around the two lateral web edges, i.e., both on the operator end and on the driven end, into the vacuum zone in this operational phase. Such penetration occurs in the region of the sealing element that cooperates with the support belt.

During operation, edge lifting or raising of the material web occurs on the straight path between the smooth support surface and the deflection roll. This lifting can occur both on the operator end and on the driven end where a special tip width region or edge strip region is not usually provided. The edge lifting is irregular and short in duration, so that a kind of web fluttering occurs. The primary cause for this lifting is the weakened vacuum after the sealing element as well as a loss in negative pressure at the two lateral edges of the material web. Air turbulence occurring between the material web and the support surface, contribute to such web lifting, which occurs near the straight course of material web between the smooth support surface and the deflection roll—both on the operator side and on the driven side.

SUMMARY OF THE INVENTION

Exemplary embodiments and advantages of the present invention may be ascertained by reviewing the present disclosure and the accompanying drawings.

An object of the invention is to produce a device of the type described above in which the above-mentioned problems are eliminated and a sufficient vacuum is achieved without expending additional energy and without requiring that the suction box be subdivided or that the vacuum zone be subdivided at all of its critical points.

This object is attained according to the present invention by providing a coherent vacuum and by providing a suction box wall with at least one additional suction opening that communicates with this vacuum zone.

Based on this embodiment, the passage of air through the suction box wall is distributed to different points so that at least one other region which has a relatively intense vacuum is provided. The at least one other region combines with the region near the first suction opening. Proper positioning of the at least one additional suction opening provides the required suction directly after the sealing element, as well as at the lateral web edges. Consequently, it is not necessary to subdivide the suction box or the vacuum zone. Further, the overall energy consumption does not increase.

Although the porous support belt is only partially covered during insertion of the tip or the leading edge strip of a material web, according to the present invention, the web tip will adhere to the porous support belt along its entire length measured in the web travel direction. By appropriately positioning the additional suction opening, it can be assured, among other things, that the external air that penetrates into the vacuum zone near the sealing element is drawn back out as rapidly as possible so that even at the front end of this vacuum zone in the web travel direction, the suction required to detach the material web from the smooth support surface prevails. Consequently, the web tip, together with the support belt, leaves the smooth support surface so that the prior application of compressed air near a scraper can be eliminated. By means of the increase in negative pressure produced at the critical points, the above-mentioned web edge lifting caused by air turbulence between the material web and the support surface, which is embodied, e.g., as a drying cylinder, can be compensated for by the increase in negative pressure produced at the critical points. Because pressure increases in the vacuum zone can be counteracted by appropriately positioning at least one additional suction opening, the web edge lifting, which occurred previously, can be practically eliminated. Consequently, such web edge lifting is practically eliminated despite the vacuum produced from the air flow emerging laterally from the machine in the region between the material web and the cylinder and despite the tendency of the web to lift from the support belt. As a result of appropriately positioning the additional suction opening, external air that entered the vacuum zone through the porous support belt is aspirated as quickly as possible out of this vacuum zone so that the suction at the critical points of the vacuum zone is intensified.

In the conventional device described above, which is known from DE-U-296 01 543, the vacuum zone is divided into a smaller partial zone limited to the exit region, and an additional partial zone adjoining it in the web travel direction. The additional partial zone extends into the region of a perforated deflection roll and is provided with suction.

According to the present invention, a device is provided for handling a material web, in which the material web is guided by at least one smooth support surface and is then guided together with a porous support belt to a deflection roll. The device includes a Suction box having a wall opposite from the porous support belt, the suction box creating a vacuum that draws the material web from the support surface to the porous support belt. The device also includes at least one sealing element provided near a front end, in the web travel direction, the sealing element cooperating with the porous support belt, and a vacuum zone in which the vacuum is provided. The vacuum zone adjoins a side of the porous support belt not contacting the material web and is defined between the porous support belt, the at least one sealing element, the wall of the suction box, and at its rear end, the deflection roll. The device also includes a slot-shaped first suction opening provided in the suction box wall near the rear end of the vacuum zone adjacent to the deflection roll so that air can be aspirated from the vacuum through the first Suction opening; and at least one additional suction opening communicating with the vacuum, the at least one additional suction opening being provided in the suction box wall.

In an embodiment of the device according to the present invention, at least one additional suction opening is embodied as slot-shaped.

The material web can be conveyed by the support surface, in conjunction with the support belt, such that the material web contacts the support surface. The sealing element in this embodiment, which is provided on the front end of the negative pressure zone and cooperates with the support belt, is positioned in the region where the support belt guiding the material web leaves the support surface.

In an embodiment of the device according to the present invention, at least one additional suction opening is disposed near the front end of the vacuum zone. A suction opening of this kind is preferably slot-shaped and can extend laterally to the web travel direction. It is also advantageous if this slot-shaped suction opening extends partially across the machine width. Such an additional, slot-shaped suction opening preferably extends at least over a region perpendicular to the web travel direction, over a region corresponding to a leading tip or a beginning edge strip of the material web.

Alternatively or additionally, it is also possible to provide at least one additional suction opening near a lateral edge of the material web. In this context, at least one such additional suction opening is preferably provided in the vicinity of each of the two web edges. In an embodiment, at least one such additional suction opening, which is provided in the vicinity of each lateral edge of the material web is disposed outside the web width such that this additional suction opening is adapted to a changing paper edge. The opening may extend in the web travel direction. The additional, slot-shaped suction opening may be provided in the vicinity of each of the two web edges, and extend outside the web width in the web travel direction.

In an embodiment, the slot-shaped suction opening is provided near the front end of the vacuum zone and extends laterally to the web travel direction. One end adjoins a slot-shaped suction opening, which is disposed near a web edge and extends in the web travel direction, and preferably feeds into this suction opening.

In addition, the first suction opening of the suction box wall can be slot-shaped, such that this first suction opening preferably extends laterally to the web travel direction. In an embodiment, this slot-shaped first suction opening extends beyond the web width on both sides.

In an embodiment of the device according to the present invention, the deflection roll is perforated and/or grooved. This deflection roll's periphery, which is not covered by the support belt and the material web, is provided with suction from an external suction box.

The support surface can be embodied as a moving surface and, in this connection, is preferably a rotating cylinder. In an embodiment, the support surface is a drying cylinder and the support belt is a drying wire.

A method is provided for handling a material web with a device including a suction box having a wall opposite from a porous support belt, the suction box creating a vacuum. The device also includes at least one sealing element provided near a front end, in the web travel direction, the sealing, element cooperating with the porous support belt. At least one additional suction opening communicating with the vacuum is provided in the suction box wall. The method includes guiding the material web with at least one smooth support surface and guiding the material web with the porous support belt to a deflection roll. The method also includes drawing the material web from the support surface to the porous support belt with a vacuum provided in a vacuum zone, the vacuum zone adjoining a side of the porous support belt not contacting the material web and being defined between the porous support belt, the at least one sealing element, the wall of the suction box, and at its rear end, the deflection roll. The method further includes aspirating air from the vacuum through a first slot-shaped suction opening provided in the suction box wall near the rear end of the vacuum zone adjacent to the deflection roll.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented to provide what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
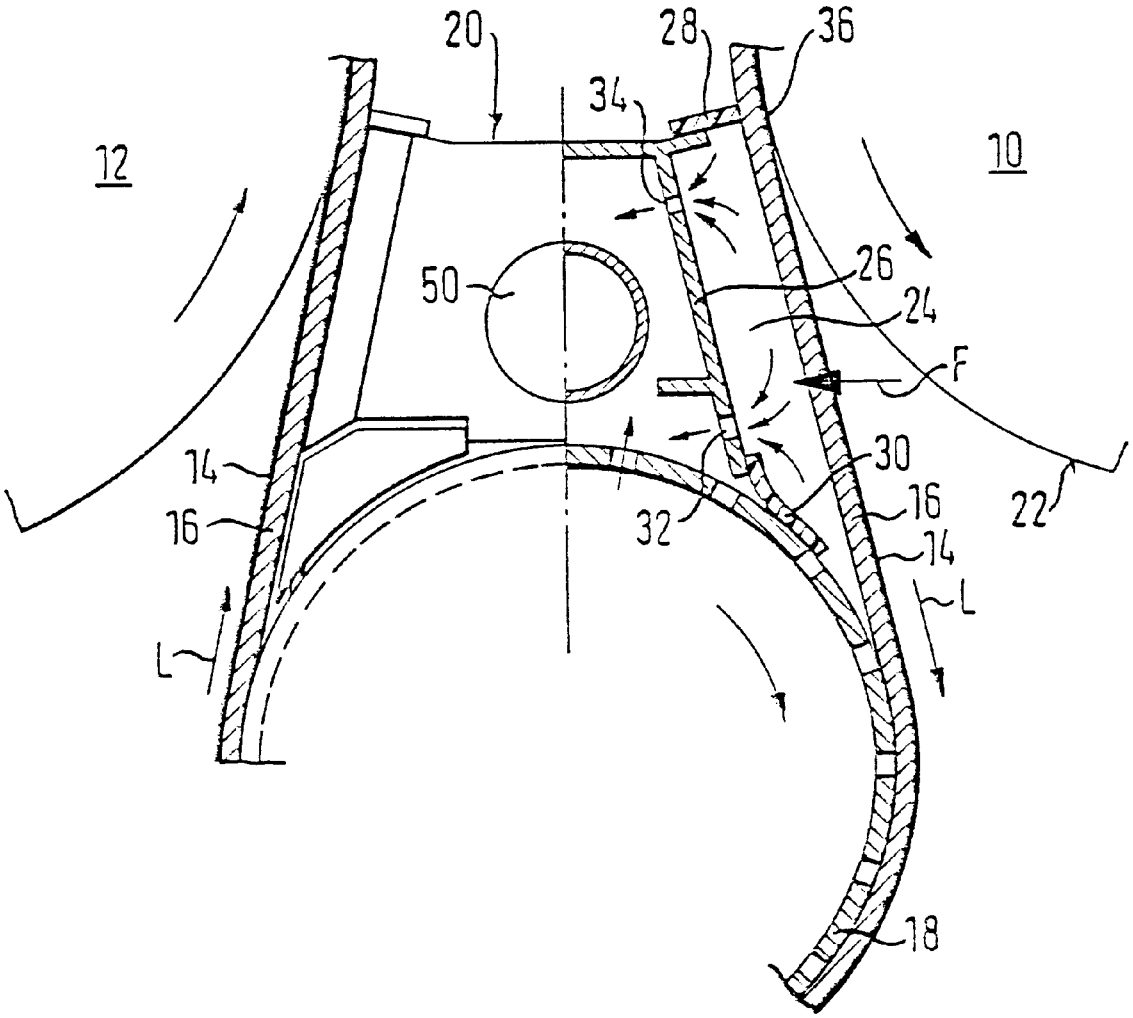
FIG. 1 is a schematic partial view of a region of a paper making machine disposed between two drying cylinders.

FIG. 1 is a schematic partial view of a region disposed between two heated drying cylinders 10, 12, of a device for heating a material web 14, such as a paper or cardboard web. As can be seen from FIG. 1, the material web 14, together with a porous support belt, which is preferably embodied as a wire belt 16, are conveyed by the drying cylinder 10 and the drying cylinder 12 and are guided between them by a perforated and/or grooved deflection roll 18. In this connection, the two drying cylinders 10 and 12 each contact the material web 14, and the deflection roll 18 contacts the wire belt 16. The deflection roll's 18 periphery that is not covered by the material web 14 and the wire belt 16, is provided with suction by an external suction box 20, which is arranged inside the loop of the wire belt 16 that is guided around the deflection roll 18.

The material web 14, which is leaving the smooth support surface 22 of the drying cylinder 10 and is guided together with the wire belt 16 in a straight line to the deflection roll 18, is drawn against the wire belt 16 by a vacuum provided in a vacuum zone 24, which adjoins the side of the wire belt 16 not contacting the material web 14. The vacuum zone 24 is defined between this side of the wire belt 16 and an opposing wall 26 of the suction box 20. On its front end in the web travel direction L, the vacuum zone 24 is sealed by a sealing element 28 that cooperates with the wire belt 16. At its rear end in the web travel direction L, this vacuum zone 24 extends to the deflection roll 18 and an additional sealing element 30, which cooperates with the deflection roll 18, is provided against the suction box wall 16. The suction box 20 is also provided with an exhaust line 50.

Figure 3:
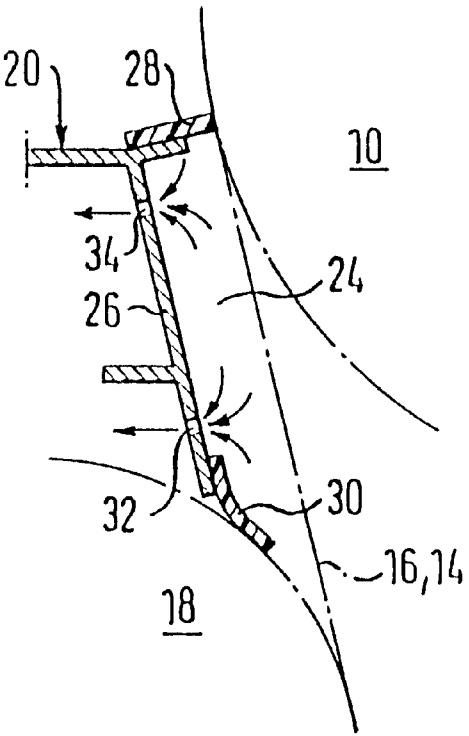
FIG. 3 is a schematic sectional view of the device according to FIG. 2, cut along the line A—A.
Figure 2:
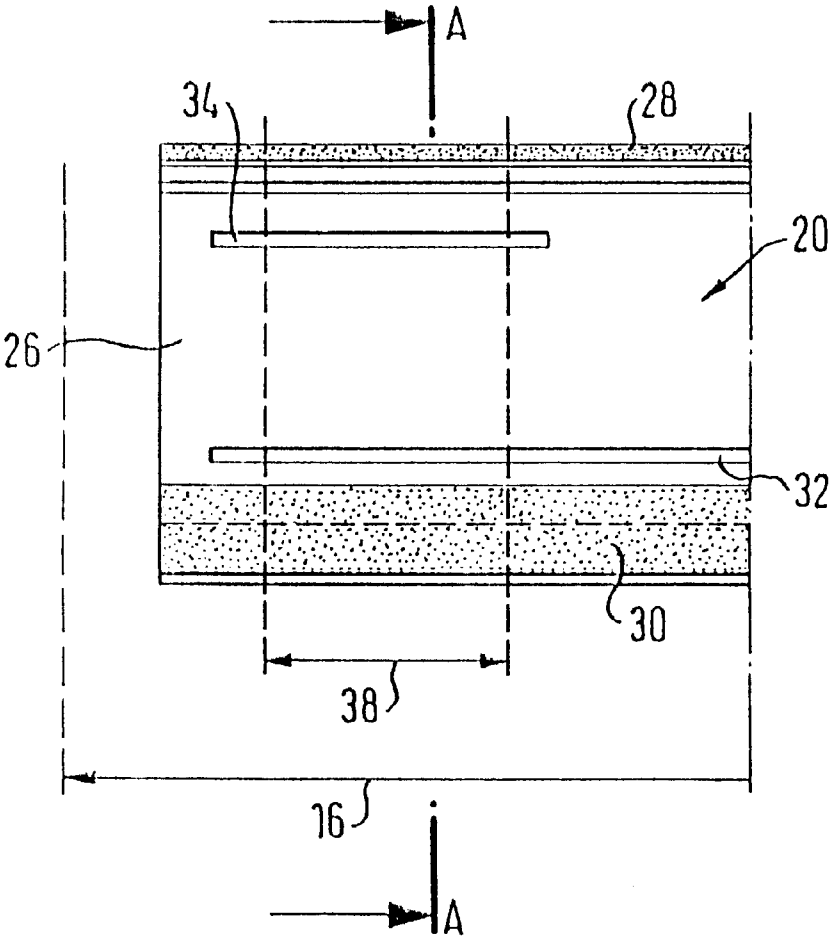
FIG. 2 is a schematic side view of a portion of the suction box in the direction of the arrow F of FIG. 1.

As can also be seen in FIGS. 2 and 3, the suction box wall 26 has a slot-shaped first suction opening 32, which extends laterally to the web travel direction L (see also FIG. 4) on both sides beyond the web width 48 in the region of the rear end of the vacuum zone 24 adjacent to the deflection roll 18 and through which air can be aspirated from the vacuum zone 24. For the sake of the present invention, slot-shaped means having generally a long and narrow shape with regular edges, such as shown in FIGS. 2 and 3.

According to the present invention, neither the suction box 20 nor the vacuum zone 24 is subdivided in the previously customary way. Therefore, a separate partial zone associated with the web tip or a leading edge strip of the material web, is also not provided. Instead of a separate zone, the suction box wall 26 is provided with an additional suction opening 34 that feeds into the vacuum zone 24.

This additional suction opening 34 is also embodied, for example, as slot-shaped. It extends laterally to the web travel direction L near the front end of the vacuum zone. It is consequently arranged in the vicinity of the sealing element 28, which likewise extends laterally to the web travel direction L and, preferably, is provided in an exit region 36 where the wire belt 16 leaves the drying cylinder 10. In the exemplary embodiment shown, the sealing element 28 is provided where the wire belt 16 and the material web 14 are still resting on the smooth outer support surface 29 of the crying cylinder 10. In an embodiment of the device according to the present invention, at least one additional suction opening is disposed near the front end of the vacuum zone to ensure that the desired suction is available immediately after the seating element.

As can be seen especially clearly from FIG. 2, the additional slot-shaped suction opening 34, which is parallel to the sealing element 28, extends only over a portion of the machine width. Preferably, the suction opening 34 extends at least over the region corresponding to a beginning tip or leading edge strip of the material web 14. In the illustrated embodiment, the slot-shaped suction opening 34 extends slightly beyond this region 38 on both ends.

As is particularly visible from FIG. 3, with the additional suction opening 34 provided near the front end of the vacuum zone 24, another region of strong suction is produced in addition to the region of the suction opening 21 and the other region joins together with the region of the first suction opening 32. Consequently, the required suction is provided at the front end of the vacuum zone 24 so that the web tip or leading edge strip of the material web 14 also adheres to the wire belt 16 along its entire length in the web travel direction L.

Figure 4:
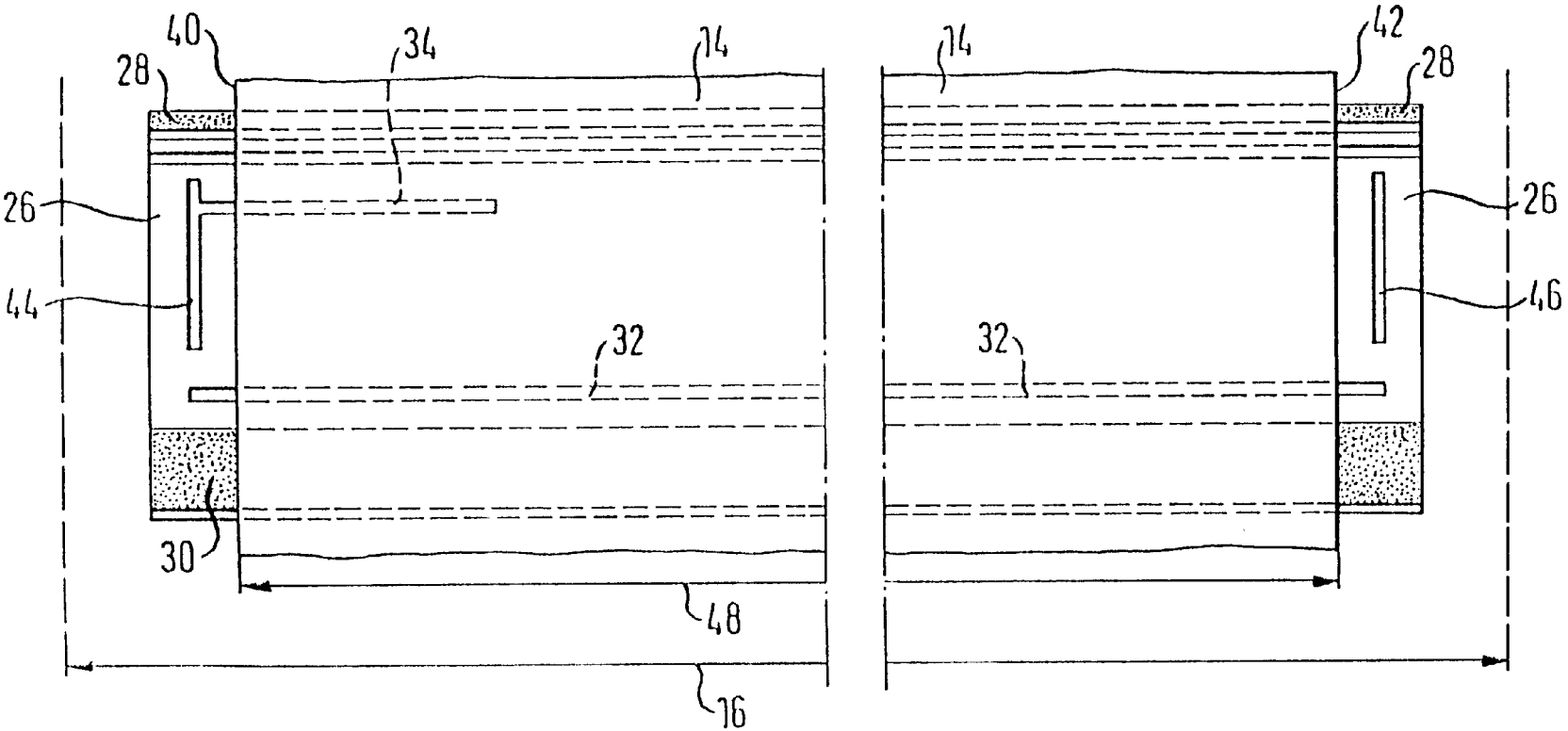
FIG. 4 is a view comparable to that of FIG. 2 of another embodiment with a suction box having an additional edge slot.

In the additional embodiment shown in FIG. 4, at least one additional slot-shaped suction opening 44, 46 is provided near each of the two web edges 40, 42. These additional slot-shaped suction openings 44, 46, each of which extend in the web travel direction L, are arranged slightly outside the web width 48 in the illustrated embodiment.

According to this embodiment, the slot-shaped suction opening 34, which is arranged near the -Front end of the vacuum zone 24, feeds with its end adjacent to the web edge 40 into the relevant additional slot-shaped suction opening 44 that extends in the web travel direction L. As can be seen from FIG. 4, the slot-shaped suction opening 44 extends towards the strip-like sealing element 28, slightly beyond the slot-shaped suction opening 34, which is parallel to the sealing element 28. On its other side, the opening 44 ends before the first suction opening 32 arranged near the rear end of the vacuum zone 24.

Otherwise, this embodiment shown in FIG. 4 has at least essentially the same design as that of FIGS. 1, 2, and 3. Also in the embodiment of FIG. 4, the slot-shaped first suction opening 32 extends beyond the web width 48 on both ends.

In all of the embodiments, the wire belt 16 extends beyond both the material web 14 and the suction box wall 26 as shown in FIGS. 2 and 4.

According to an alternate embodiment, a series of several small suction openings, arranged one after the other, is provided instead of a suction slot.

It is noted that the foregoing examples have been provided merely for the purpose of explanation and are in no way to be construed as limiting of the present invention. While the present invention has been described with reference to exemplary embodiments, it is understood that the words that have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as arc within the scope of the appended claims.

What is claimed:

1. A device for handling a material web, in which the material web is guided by at least one smooth support surface and is then guided together with a porous support belt to a deflection roll, the device comprising:

a suction box having a wall opposite from the porous support belt, the suction box creating a vacuum that draws the material web from the support surface to the porous support belt;

at least one scaling element provided near a front end, in the web travel direction, the scaling element cooperating with the porous support belt;

a vacuum zone in which the vacuum is provided, the vacuum zone adjoining a side of the porous support belt not contacting the material web and being defined between the porous support belt, the at least one scaling element, the wall of the suction box, and at its rear end, the deflection roll;

a slot-shaped first suction opening provided in the suction box wall near the rear end of the vacuum zone adjacent to the deflection roll so that air can be aspirated from the vacuum through the first suction opening;

at least one additional suction opening communicating with the vacuum, the at least one additional suction opening being provided in the suction box wall;

deflection roll being at least one of perforated and grooved; and the suction box being arranged to externally supply suction to a periphery of the deflection roll which is not covered by the support belt and the material web.

2. The device according to claim 1, in which the at least one additional suction opening is slot-shaped.

3. The device according to claim 1, in which the material web and the support belt are guided by the support surface, so that the material web contacts the support surface.

4. The device according to claim 3, in which the sealing element is positioned in the region where the support belt that guides the material web leaves the support surface.

5. The device according to claim 1, in which the at least one additional suction opening is provided near the front end of the vacuum zone.

6. The device according to claim 5, in which the at least one additional suction opening extends laterally to the web travel direction.

7. The device according to claim 6, in which the at least one additional suction opening extends partially across machine width.

8. The device according to claim 7, in which the at least one additional suction opening extends laterally to the web travel direction at least across a region corresponding to a beginning tip or a leading edge strip of the material web.

9. The device according to claim 1, in which the at least one additional suction opening is positioned near each lateral edge of the material web.

10. The device according to claim 9, in which the at least one additional suction opening is provided near both web edges.

11. The device according to claim 9, in which the at least one additional suction opening is positioned outside the web width so that the at least one additional suction opening is adapted to a variable paper edge.

12. The device according to one of claim 9, in which the at least one additional suction opening extends in the web travel direction.

13. The device according to claim 12, in which the at least one additional suction opening is provided near both web edges and extends outside the web width in the web travel direction.

14. The device according to claim 1, in which the at least one end of the at least one additional suctioning opening is provided near the front end of the vacuum zone and extends laterally to the web travel direction, and adjoins a slot-shaped suction opening, which is positioned near a web edge and extends in the web travel direction into the at least one additional suction opening.

15. The device according to claim 1, in which the first suction opening extends laterally to the web travel direction.

16. The device according to claim 1, in which the first suction opening extends beyond both sides of the web width.

17. The device according to claim 1, in which the support surface comprises a moving surface of a rotating cylinder.

18. The device according to claim 17, in which the support surface comprises a drying cylinder and the support belt comprises a drying wire.

19. A device for handling a material web, in which the material web is guided by at least one smooth support surface and is then guided together with a porous support belt to a deflection roll, the material web and the support belt being guided by the support surface, so that the material web contacts the support surface, the device comprising:

a suction box having a wall opposite from the porous support belt, the suction box creating a vacuum that draws the material web from the support surface to the porous support belt;

at least one sealing element provided near a front end, in the web travel direction, in the region where the support belt that guides the material web leaves the support surface, the sealing element cooperating with the porous support belt;

a vacuum zone in which the vacuum is provided, the vacuum zone adjoining a side of the porous support belt not contacting the material web and being defined between the porous support belt, the at least one sealing element, the wall of the suction box, and at its rear end, the deflection roll;

a slot-shaped first suction opening provided in the suction box wall near the rear end of the vacuum zone adjacent to the deflection roll so that air can be aspirated from the vacuum through the first suction opening, the first suction opening extending laterally to the web travel direction and beyond both sides of the web width;

at least one additional slot-shaped suction opening communicating with the vacuum, the at least one additional suction opening being provided in the suction box wall near the front end of the vacuum zone, near each lateral edge of the material web, outside the web width so that the at least one additional suction opening is adapted to a variable paper edge, the at least one additional slot-shaped suction opening extending in the web travel direction laterally to the web travel direction partially across the machine width, at least one end of the at least one additional suction opening being provided near the front end of the vacuum zone and extending laterally to the web travel direction, and adjoining a slot-shaped suction opening, which is provided near a web edge and extends in the web travel direction into the at least one additional suction opening;

the deflection roll being at least one of perforated and grooved; and the suction box being arranged to externally supply suction to a periphery of the deflection roll which is not covered by the support belt and the material web.

* * * * *